United States Patent [19]

Pearlman et al.

[11] 4,044,642

[45] Aug. 30, 1977

[54] TOUCH SENSITIVE POLYPHONIC MUSICAL INSTRUMENT

[75] Inventors: Alan R. Pearlman, Newton Highlands; Dennis P. Colin, Beverly, both of Mass.

[73] Assignee: ARP Instruments, Inc., Lexington, Mass.

[21] Appl. No.: 518,347

[22] Filed: Oct. 29, 1974

Related U.S. Application Data

[62] Division of Ser. No. 381,783, July 23, 1973, abandoned, which is a division of Ser. No. 263,178, June 15, 1972, Pat. No. 3,784,935.

[51] Int. Cl.[2] ..... G10H 1/02; G10H 5/02

[52] U.S. Cl. ..... 84/1.1; 84/1.19; 84/1.24; 84/DIG. 7; 84/DIG. 9; 333/70 CR; 333/70 S; 340/365 A

[58] Field of Search ..... 84/1.01, 1.09–1.11, 84/1.19, 1.24, 1.25, 1.27, DIG. 7, DIG. 8, DIG. 9; 200/5 A, 238, DIG. 32; 338/69, 114, 115; 340/365 A; 333/70 R, 70 CR, 70 S

[56] References Cited

U.S. PATENT DOCUMENTS

| | | | |
|---|---|---|---|
| 3,609,201 | 9/1971 | Adachi | 84/1.01 |
| 3,617,666 | 11/1971 | Braue | 340/365 A X |
| 3,626,350 | 12/1971 | Suzuki et al. | 338/69 |
| 3,699,294 | 10/1972 | Suddeth | 200/5 A X |

*Primary Examiner*—Stanley J. Witkowski
*Attorney, Agent, or Firm*—Cesari and McKenna

[57] ABSTRACT

A touch sensitive device is associated with at least one key of an electronic musical instrument such as an electronic organ, includes a layer of a pressure responsive, variable conductance material, and exhibits a switching action when subjected to pressure beyond a threshold pressure, any increase in pressure thereafter providing an increase in conductance up to a saturation pressure. The device may be used either as a combined switch and amplitude control or may be used in associated with one or more capacitors to provide either a high pass or low pass touch-control audio filter. In a totally polyphonic instrument a tone generator and touch-control filter are respectively associated with and responsive to each key depression, the output signal from each activated filter being coupled preferably to audio mixer circuitry.

19 Claims, 21 Drawing Figures

TOUCH SENSITIVE POLYPHONIC MUSICAL INSTRUMENT

The present application is a division of U.S. patent application Ser. No. 381,783, filed July 23, 1973, and now abandoned which in turn is a division of U.S. patent application Ser. No. 263,178 filed June 15, 1972, and now U.S. Pat. No. 3,784,935.

FIELD OF THE INVENTION

The present invention relates to pressure-sensitive devices preferably adapted for use in electronic musical instruments. More particularly, the present invention is concerned with pressure-sensitive devices associated with the keys of an electronic musical instrument for providing amplitude control or audio filtering.

BACKGROUND OF THE INVENTION

It has long been appreciated that one of the more desirable attributes of a piano is that the amplitude of the tones provided by the piano are each separately under the control of the respective finger of the player, immediately as sounded. Thus, a piano even when used as a single voiced instrument is nevertheless capable of expressing shades of dynamic control unattainable in other keyboard instruments such as organs or harpsichords.

One early instrument, the clavichord, did have the ability to affect pitch to a limited extent after the key has been depressed. Since the key contacts the string via a tangential contact element during the time that the note is held, extra finger pressure can cause the note to become sharp while the string is vibrating.

Historically, dynamic control in organs has been achieved through the use of a foot pedal, for example, but the control thus provided is comparatively coarse and usually applies to all notes sounded simultaneously at a given time. Organs and other instruments operated by keys or a keyboard are today frequently electronic in nature, i.e., the various tones are generated by electronic means and the tones are switched electrically by manipulation of the keys, the ultimate output of the instrument being produced typically at one or more audio speakers. Attempts have been made to endow such instruments with touch sensitivity in order to expand the dynamic capabilities of the instrument, but such efforts, when successful, have involved a fairly complex and usually very expensive system. For example, it is known that strain gauges, electromagnetic transducers, and piezoelectric crystals can be employed inasmuch as they tend to produce an output which varies with pressure. However, the use of such devices is expensive and requires complex auxiliary electronic circuitry.

The mechanical linkage in instruments such as the piano is also complex and relatively expensive, and has the disadvantage that it can only produce percussive effects proportional to finger velocity when the key is first depressed, since the hammer which contacts the string is designed to fall away from the string after initially striking the string.

Moreover, prior art electronic musical instruments do not provide touch-sensitive audio filters wherein a filter may preferably be associated with each key of the instrument. A typical known instrument comprises, inter alia, a keyboard and corresponding voltage divider, control circuitry, envelope generator and voltage controlled oscillators. These instruments may provide some degree of touch-sensitive amplitude control but usually discrete control associated with each and every key is not practical as the cost is prohibitive. Also, with these instruments direct touch-responsive filtering has not been used. Usually the applied pressure is converted to a voltage which is then used to control voltage-controlled filters or voltage-controlled amplifiers. A voltage-controlled filter is relatively expensive. Furthermore, the inclusion of resistive voltage dividers, relatively complex control circuitry and envelope generators adds significantly to the overall cost of the instrument.

OBJECTS OF THE INVENTION

Accordingly, a principal object of the present invention is to provide a touch-sensitive polyphonic musical instrument including an improved touch-sensitive device wherein most of the problems of the prior art referred to hereinabove are overcome.

Another object of the present invention is to provide a new system concept for a polyphonic musical instrument wherein much of the prior art circuitry such as transient envelope-control generators and voltage-controlled filters can be eliminated. This basic system includes a tone generator (oscillator) associated with each key and a touch-sensitive audio filter whose frequency response varies in response to the pressure applied to the respective key.

Still another object of the present invention is to provide a system in accordance with the preceding object comprising a control voltage generator and voltage controlled amplifier associated with each key with the input of the amplifier derived from the tone generator and the output of the amplifier combined with the output of the touch sensitive audio filter. The gain of the voltage controlled amplifier is controlled from the control voltage generator and in such a way that when the key is released the audio output of the amplifier decays away at a predetermined time constant.

A further object of the present invention is to provide a touch-sensitive device disposed in functional relationship to a key of a musical instrument and that requires only a small displacement, hence making it suitable for use in instruments which employ keyboards or fingerboards wherein rapid playing has heretofore been hindered by the necessity for large key excursions.

Still another object of the present invention is to provide a touch-sensitive device that is relatively small and inexpensive to construct, thereby making the device particularly suitable for use in polyphonic instruments wherein the cost per device must be kept low.

Another object of the present invention is to provide a touch-sensitive device which is simple in construction, employs inexpensive components and is not difficult to assemble.

Still another object of the present invention is to provide a touch-sensitive device constructed as a filter circuit having a variable cutoff frequency in dependence upon the applied pressure.

Still another object of the present invention is to provide a plurality of touch-sensitive devices which are relatively compact and easily stacked preferably one above the other, wherein these devices are actuated from a single key. This stack of touch-sensitive devices is preferably designed for actuation with modest pressures applied to the key.

A further object of the present invention is to provide a variable controlled voltage output preferably taken from one of the touch-sensitive devices of a stack of such devices, and which is suitable for operating special effects responsive to key pressure, such as vibrato, growl, pitch blend, etc.

SUMMARY OF THE INVENTION

In accordance with one aspect of the present invention there is provided a novel polyphonic musical instrument preferably of the clavichord keyboard type and comprising a plurality of tone generators, one associated with each key of the keyboard, and preferably a like plurality of touch-sensitive devices, each responsive to the actuation of a corresponding key and associated with a corresponding tone generator. Each tone generator may include a square wave oscillator, saw-tooth oscillator or other waveform oscillator, with each tone generator set to operate at the appropriate musical frequency. In one embodiment of the invention, the touch-sensitive device functions as a switch between a condition of no load or pressure and a threshold pressure and thereafter exhibits a conductance which varies responsively to additional increasing pressure. In another embodiment associated with the system concept of the present invention, there is provided a touch-sensitive audio filter comprising a plurality of discrete touch responsive conductance means having a plurality of discrete reactance means associated therewith to form either a high pass or low pass filter arrangement having a cutoff frequency that varies in accordance with the applied pressure.

In accordance with another aspect of the present invention, there is provided a voltage controlled amplifier associated with each key and connected so that a portion of the signal from the tone generator associated with that key is amplified by an amount which is responsive to the pressure applied to the key. The voltage controlled amplifier has means associated therewith so that when the key is released the signal output of the amplifier decays away at a predetermined time constant. In the aforementioned embodiment there may also be provided a control voltage output responsive to key pressure and suitable for controlling vibrato or other special effects.

DESCRIPTION OF THE DRAWINGS

Numerous other objects, features and advantages of the invention will now become apparent upon a reading of the following detailed description taken in conjunction with the accompanying drawings in which.

DETAILED DESCRIPTION

To accomplish the foregoing and other objects of the invention there is provided a device including a body formed of an elastically deformable electrically-insulating material admixed with particles of an electrically conductive material and characterized in that when deformed, e.g. by compressive force, the body exhibits, at least in the direction of the compressive force, an electrical conductance which increases with the compressive load or pressure. The device also includes electrical leads intended to contact respective portions of the deformable body at points along the direction of compression so as to be able to introduce an electrical current through the body. Further, in a preferred form wherein the device is intended to function as a switch, there is positioned between one of the leads and the deformable body, a substantially electrically insulating material having therein an aperture. The deformable body and the one lead are disposed at opposite ends of the aperture and normally held spaced apart or out of contact with one another in the absence of a compressive force, and are positioned such that when a compressive force is applied, the deformable body is deformed so as to extend into the aperture and contact the lead, thereby effecting a switching action. In yet other embodiments of the invention, the deformable bc ly and leads are used in multiple to constitute the resistive impedances in an RC filter network.

Figure 1:
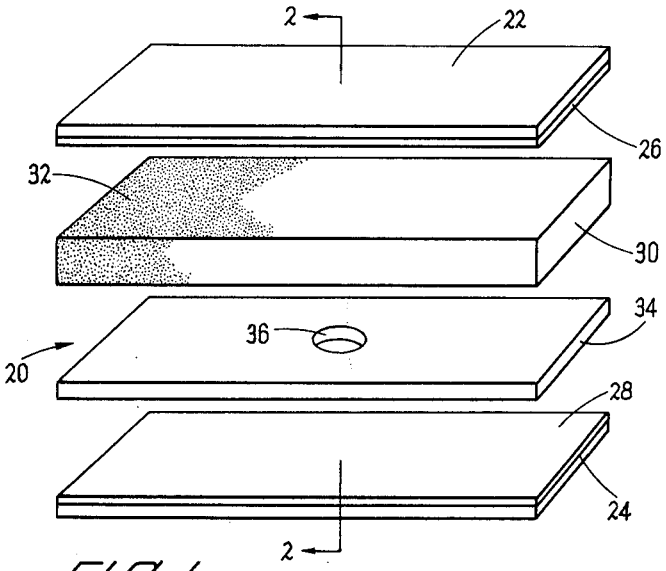
FIG. 1 is an expanded perspective view showing the elements of an exemplary key switch embodying the principles of the present invention.

Referring now to the drawings there is shown in FIG. 1 an exploded perspective view of a typical device 20 embodying the principles of the present invention and comprising upper and lower elements 22 and 24 preferably composed of synthetic polymeric material or other electrically insulating material. As shown particularly in FIG. 2, positioned immediately adjacent to and in contact with the lower surface of upper element 22, and with the upper surface of lower element 24, are electrically conductive elements 26, 28, respectively, preferably composed of thin metal films clad to elements 22 and 24. The laminates formed of elements 22 and 26 and elements 24 and 28 advantageously can simply be unetched printed circuit board (ca. 1/32 inch formed of gold plated copper cladding on an epoxy-glass base.

An elastically deformable and compressible slab 30 formed of a mixture of electrically insulating material which preferably provies the elasticity as well, and electrically conductive, comminuted material is positioned immediately adjacent to and in contact with the lower surface of electrically conductive element 26. Typically, the electrically insulating material can be formed of natural polyers, e.g. foamed rubber, or a foamed synthetic polymeric material such as polymers and copolymers of ethylene, urethane and the like. Particles of conductive material 32 such as graphite are distributed throughout the electrically insulating material in such quantity size and distribution so that when slab 30 is deformed, e.g. by compressive force, the electrical conductance across the slab in the direction of compression increases, and when the compressive force is reduced the electrical conductance across the slab decreases. Preferably the particles of conductive material are admixed substantially uniformly through the insulating material. Under no compressive load slab 30 exhibits a minimum conductance dependent upon the slab thickness, density of conductive particles in the slab, particle size and similar parameters. Such resilient materials exhibiting conductivity change with pressure are commercially available.

A spacer 34 formed of an electrically insulating material having an aperture 36 therethrough is positioned between and immediately adjacent to and in contact with the lower surface of slab 30 and the upper surface of electrically conductive element 28. Typically spacer 34 is formed of a relatively rigid electrically insulating material such as epoxy-glass, or a synthetic polymeric material such as rigid polyvinyl chloride, rigid acetate, rigid vinyl, high impact styrene, phenolic polymers and the like. Spacer 34 is sufficiently thick so that in the absence of a compressive force, element 28 will be spaced apart from slab 30. Conversely, spacer 34 is thin enough so that under sufficient compressive load slab 30 will be deformed and extend through aperture 36 and contact element 28. The amount of pressure necessary to effect electrical contact between element 28 and slab 30, i.e., the so-called "threshold pressure", will depend on the thickness of slab 30, its resiliency, the thickness of spacer 34, and the size and shape of aperture 36. One skilled in the art will be able to determine suitable parameters depending on the desired threshold pressure.

Aperture 36 typically has a diameter around ⅜ inch. Electrical leads 40 and 42 which serve as terminals for an electrical circuit, are attached to upper and lower conductive elements 26 and 28, respectively.

Figure 2:
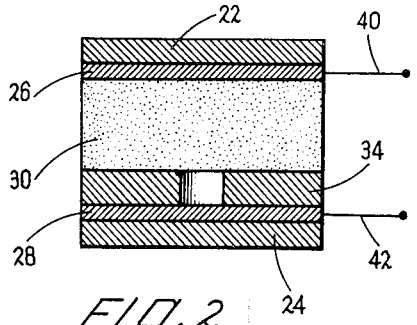
FIG. 2 is a cross-section taken through an assembled form of the structure of FIG. 1.
Figure 3:
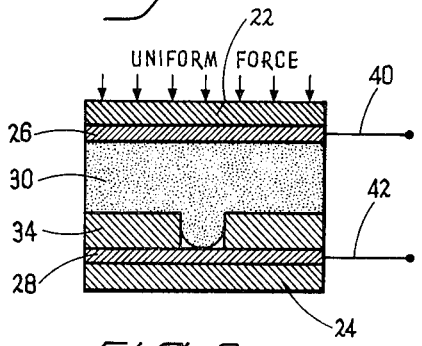
FIG. 3 is the structure of FIG. 2 under a compressive load.

Referring now to FIG. 3, there is shown the structure of FIG. 2 under a compressive load applied to upper element 22. The structure is attached to a suitable frame (not shown). The compressive load presses upper element 22 downward which compresses deformable slab 30 and forces a portion of slab 30 through aperture 36 into contact with lower conductive element 28. This completes the circuit between element 26 and 28. It will be understood that when the compressive force is removed, elastically deformable slab 30 will urge upper element 22 to return to its normal position, and break the circuit between elements 26 and 28.

Figure 4:
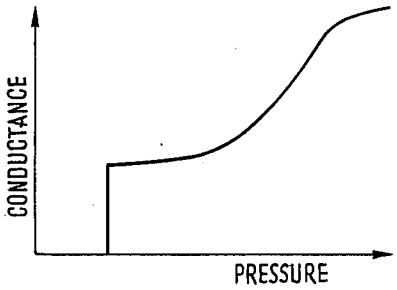
FIG. 4 is a graphical plot of conductance against pressure, illustrating operation of the embodiment of FIG. 1.

In FIG. 4 there is shown a conductance profile as a function of pressure in a structure of the present invention. Until the threshold pressure is reached electrical conductance across the device is zero or negligible. As threshold pressure, conductance increases abruptly. Above threshold pressure, conductance increases proportionately, if non-linearly, to increases in pressure. Conductivity continues to rise with pressure until the compressibility of slab 30 approaches its limit.

Figure 5:
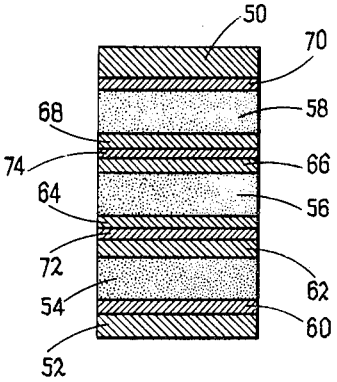
FIG. 5 is a cross-section taken through an exemplary embodiment of a portion of a touch-sensitive plurality of paralleled resistors embodying the principles of the present invention.

In FIG. 5 there is shown a cross-section of another device embodying the principles of the present invention and useful to provide a plurality of parallel, pressure variable resistors for use in a pressure sensitive, variable high-pass filter. The device comprises upper and lower elements 50, 52, a plurality of elastically deformable slabs 54, 56, 58 formed of a mixture of electrically insulating material and electrically conductive, comminuted material of the type described hereinabove stacked one upon another between elements 50 and 52, and sandwiched between respective pairs of electrically conductive elements 60 and 62, 64 and 66, 68 and 70, respectively. Spacers 72 and 74, formed of electrically insulating material are positioned between elements 62 and 64, 66 and 68, respectively.

Figure 6:
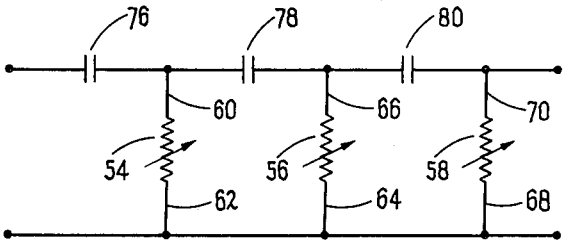
FIG. 6 is a circuit diagram showing the embodiment of FIG. 5 used to form an exemplary high-pass filter.

FIG. 6 is a circuit diagram showing an embodiment of an exemplary high-pass filter employing the device of FIG. 5. In such circuit a plurality of variable resistors, which are respectively slabs 54, 56 and 58, are connected through elements 60, 62, 64, 66, 68 and 70 to one another. Capacitors 76, 78 and 80 are connected in series, element 60 being connected between capacitors 76 and 78, element 66 being connected between capacitors 78 and 80 and element 70 being connected to the opposite plate of capacitor 80. Elements 62, 64 and 68 of course are connected to one another. It will be apparent that the filter of FIG. 6 provides frequency attenuation and pass characteristics variable in response to pressure applied to it.

Figure 7:
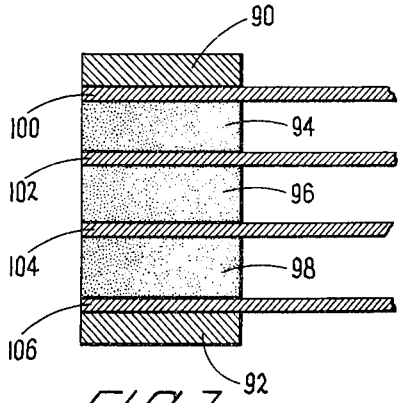
FIG. 7 is a cross-section taken through a portion of an embodiment of a touch-sensitive plurality of series connected resistors embodying the principles of the present invention.

In FIG. 7 there is shown a cross-section of another embodiment of the present invention useful to form a low-pass filter device. The device comprises upper and lower rigid insulating elements 90, and 92, a plurality of resiliently compressible slabs 94, 96 and 98, formed of a mixture of electrically insulating material and electrically conductive, comminuted material of the type described previously, stacked respectively between electrically conductive elements 100 and 102, 102, and 104, and 104 and 106. It will be seen that all layers between insulators 90 and 92 are electrically connected.

Figure 8:
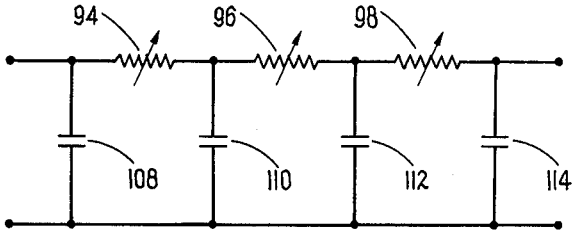
FIG. 8 is a circuit diagram of an exemplary low-pass filter incorporating the embodiment of FIG. 7.

FIG. 8 is a circuit diagram of an exemplary low-pass filter using the device of FIG. 7. The circuit of FIG. 8 includes a plurality of parallel connected capacitors 108, 110, 112 and 114. One side of each capacitor is coupled to a corresponding side of the other capacitors. Slabs 94, 96 and 98 are respectively connected between the other plates of capacitors 108 and 110, capacitors 110 and 112 and capacitors 112 and 114.

It should be noted that the touch sensitive device of the present invention has an advantage in that its output is not particularly temperature sensitive. It will be seen from the foregoing that in addition to the advantages hereinabove enumerated the device of the present invention has a high operating life since there is no dependence on mechanical parts to rub or slide one another, and there are no contacts which may arc or burn. The cost of manufacturing the device is low, due in part to the inexpensive materials and due also to the simple assembly.

A touch sensitive structure of the type disclosed in FIGS. 1 to 3 is useful in electronic keyboard instruments. Typically, only two such devices need be used for an entire keyboard, one, for example, being disposed under each end of the keyboard frame with the two devices being electrically connected in parallel. Such a system will provide the same dynamics for all keys depressed at a given time. Alternatively, each key in a keyboard can be mechanically coupled to a corresponding touch sensitive switch and resistor of the type shown in FIGS. 1 to 3, thereby increasing the dynamic alternatives. Devices of the type shown in FIGS. 5 and 7 are also useful in certain keyboard devices, particularly electronic music synthesizers.

Figure 9:
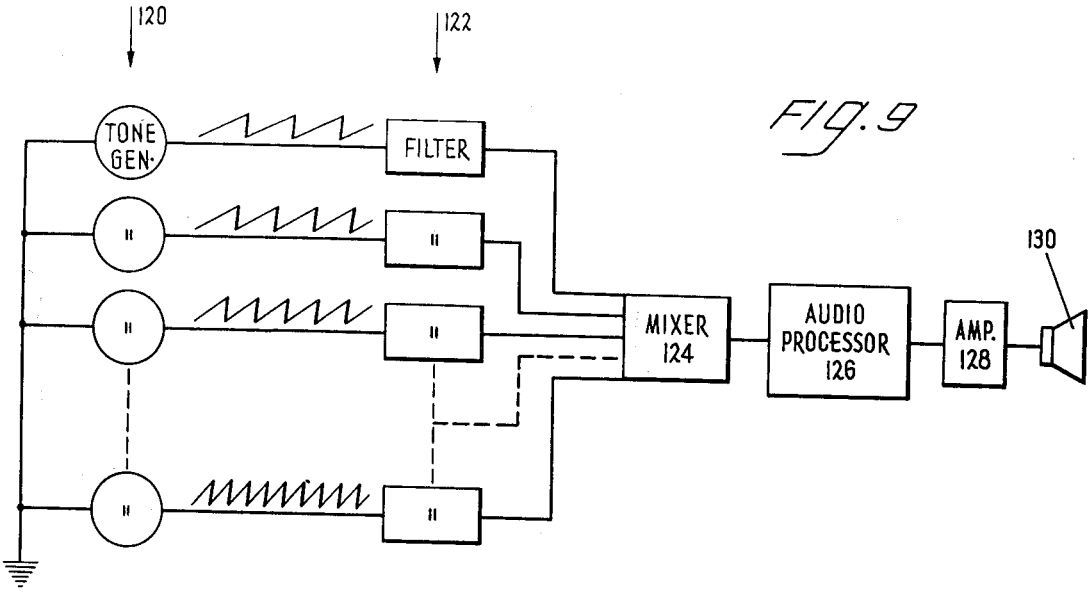
FIG. 9 is a block diagram of a touch-sensitive system for use in a polyphonic musical instrument or music synthesizer.

Referring now to FIG. 9 there is shown a block diagram of a touch sensitive system constructed in accordance with the system concept of the present invention for providing a polyphonic musical instrument. The system comprises an array 120 of tone generators, a corresponding array 122 of touch responsive filters, a mixer circuit 124, an audio processor 126, an amplifier 128, and an output speaker 130. The tone generators may be of conventional design and the output therefrom, as indicated in FIG. 9, may be a sawtooth waveform of a frequency corresponding to the desired note. The output from each tone generator couples to a corresponding touch responsive filter of filter array 122. Each of the filters shown in FIG. 9 may be of the type disclosed in FIG. 10. FIG. 11 shows the equivalent circuit for the structure of FIG. 10 which is a low pass filter network. The output of all of the filters of array 122 couples to the mixer circuit 124 which may be of conventional design and is adapted to mix the tones passed by the filters of array 122. The output of the mixer circuit then couples to conventional audio processor 126 and amplifier 128.

Figure 10:
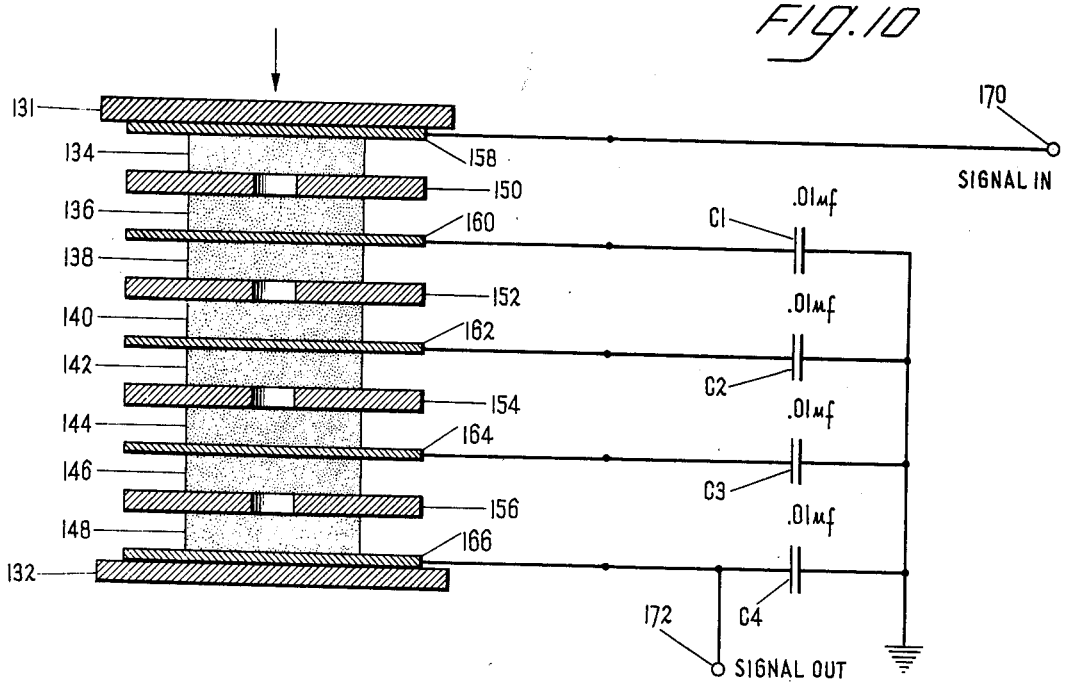
FIG. 10 is an enlarged cross-sectional view of another embodiment of a touch controlled filter that may be used in the block diagram of FIG. 9.
Figure 11:
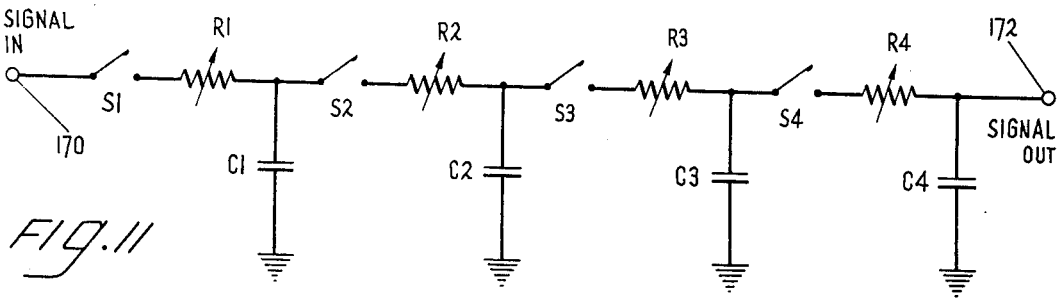
FIG. 11 shows the circuit equivalent for the touch controller filter of FIG. 10.

In FIG. 10 there is shown an enlarged cross-section of another device embodying the principles of the present invention for providing a plurality of parallel, pressure variable resistors for use in a pressure sensitive, variable low pass filter. FIG. 10 also shows the discrete capacitors that comprise the low pass filter. The device comprises upper and lower elements 131 and 132 which may be formed of a mylar insulator. A plurality of pairs of elastically deformable slabs 134, 136; 138, 140; 142, 144; and 146, 148 may be constructed of a material similar to that discussed with reference to the slabs 94, 96 and 98 of FIG. 7 but it is preferred that the slabs be constructed of an elastically deformable but relatively incompressible material such as a plastic having conductive particles therein. One material used is sold by Custom Materials, Inc. under the trademark VELOSTAT. Each of the pairs of slabs is separated by a mylar aperture plate shown in FIG. 10 as aperture plates 150, 152, 154 and 156, respectively. The device also comprises a plurality of spaced conductive strips which may be formed of copper foil. These conductive strips are shown in FIG. 10 at 158, 160, 162, 164 and 166, and each of the pairs of slabs with their associated aperture plate are sandwiched between the spaced conductive plates, as shown.

The signal input at terminal 170 couples to conductive strip 158, and the other conductive strips 160, 162, 164 and 166 couple, respectively, to capacitor C1, C2, C3 and C4. The other side of the capacitors C1–C4 is tied to ground and the output signal at terminal 172 is coupled from plate 166.

In the position shown in FIG. 10 when the input signal is fed from a tone generator to input terminal 170 the touch sensitive device essentially blocks the signal to the output terminal 172 because the pairs of conductive slabs are in their non-contacting position.

FIG. 11 shows the circuit equivalent of the filter of FIG. 10 including input signal terminal 170, output signal terminal 172 and capacitors C1–C4. The variable conductances of the device of FIG. 10 which comprise conductive pair slabs 134, 136; 138, 140; 142, 144; 146, 148 are illustratively represented in FIG. 11 by the switch-resistor combinations S1, R1; S2, R2; S3, R3; and S4, R4, respectively. In FIG. 10 the values of capacitors C1–C4 are all the same. In another embodiment the R1, C1; R2, C2; R3, C3; and R4, C4 time constants are maintained constant. When the device has been sufficiently depressed the switches S1–S4 close. The corresponding values of R1, R2, R3 and R4 are different at any one given applied pressure. Resistor R1 has the lowest value and resistors R2, R3 and R4 have higher values in sequence. Thus, the capacitors C1–C4 are selected so that capacitor C1 has the highest capacitance and capacitors C2, C3 and C4 have lower capacitance in decreasing sequential order.

Figure 12:
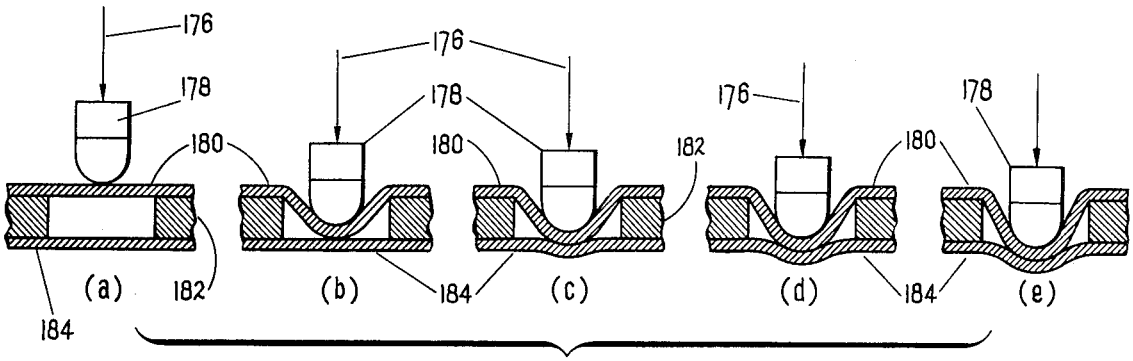
FIG. 12 shows a series of cross-sectional views through a portion of the filter of FIG. 10 for differently applied compressive forces.

FIG. 12 shows a series of partial, enlarged, cross-sectional views (a)–(e) through the variable resistance portion of the filter of FIG. 10 for differently applied compressive forces. In FIG. 12 the arrow 176 indicates the direction in which concentrated pressure is being applied to a rubber pad 178, and this pressure is applied directly or indirectly against one of the conductive slabs such as slab 134 in FIG. 10.

In FIG. 12(a) pad 178 has no pressure applied thereto and it is shown as just barely touching conductive plastic slab 180. The aperture plate 182 prevents contact between slab 180 and slab 184 which is disposed therebelow. In FIG. 12(b) a minimum predetermined threshold pressure has been applied in the direction of arrow 176 to pad 178 and the slab 180 has deflected enough so that it contacts lower slab 182. Thus, the switch contact has closed. In FIG. 12(c) an increased pressure above the threshold pressure has been applied and it is noted that the lower slab 182 deforms slightly downwardly in the area in the center of the aperture plate 182. In FIG. 12(d) a moderate pressure has been applied and the plate 184 has deflected further. In FIG. 12(e) the saturation pressure has been reached and there is a maximum downward deflection of bottom slab 184.

Figure 13:
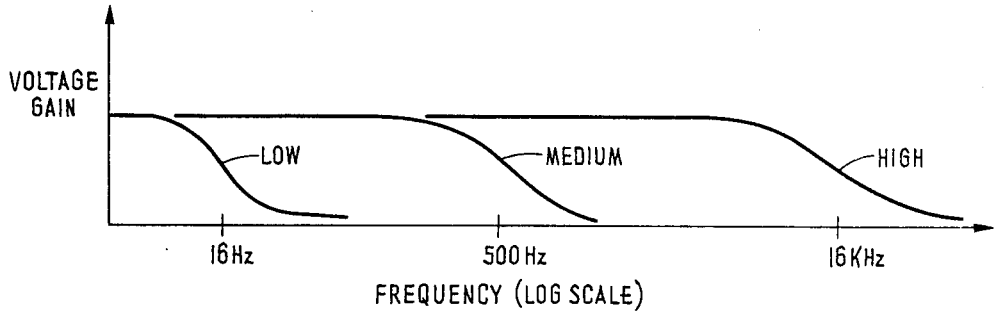
FIG. 13 is a plot of voltage gain vs. frequency for the filter of FIG. 10 for low, moderate and high pressures.

FIG. 13 is a plot of frequency on a logarithmic scale versus voltage gain for the low pass filter of FIGS. 10 and 11. The three waveforms depicted in FIG. 13 correspond, respectively, with the three positions shown in FIGS. 12(c), 12(d) and 12(e). When a relatively low pressure is being applied the resistances of the filter are relatively high and there is a low frequency cutoff of say 16 Hertz as shown in FIG. 13. When a medium pressure is being applied the cutoff frequency may be on the order of 500 Hertz and at high pressure the cutoff frequency may be 16K Hertz.

Figure 14:
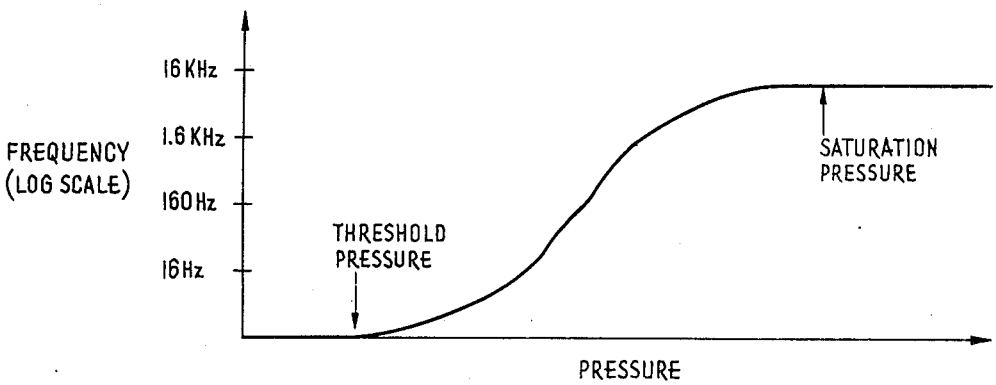
FIG. 14 is a plot of pressure vs. cutoff frequency of the filter of FIG. 10.

FIG. 14 shows another plot of pressure on a linear scale versus frequency on a logarithmic scale. Once the threshold pressure is reached, increased pressure causes the frequency response of the filter to increase in the manner shown in the waveform of FIG. 14. As indicated in FIG. 14 the saturation pressure is reached in one embodiment at a frequency of approximately 16K Hertz.

The embodiment shown in FIGS. 10 and 12 may employ an elastically deformable but relatively incompressible material, such as a sheet of silicone rubber containing an admixture of conductive particles such as amorphous carbon, graphite, or silver. If such a material is used in place of a compressible foam, deformation can be effected by the use of a more concentrated force such as the one applied in FIG. 12, rather than a more distributed force, such as could be applied to the embodiment of FIG. 3. With the relatively incompressible material conductance modulation is achieved almost exclusively by the variation of the area of contact (see FIG. 12) under pressure, rather than by the compression of a spongy material. The conductance increases (resistance decreases) as the pressure increases which in turn causes an increase in the area of contact. Since material such as silver-loaded silicone rubber exhibits extremely low resistivity it may be desirable to utilize a relatively high resistance carbon film on the surface of the conductor which is contacted by the silver-loaded silicon rubber on the other side of the aperture.

In the embodiments shown in FIGS. 5 and 7 the variable conductance slabs are used without any aperture plate associated therewith. However, an alternate embodiment may be used that adds aperture plates so that the device also provides a switch function. For example, in the embodiment of FIG. 5 aperture plates may be used between element 68 and slab 58; element 64 and slab 56; and element 60 and slab 54.

Figure 15:
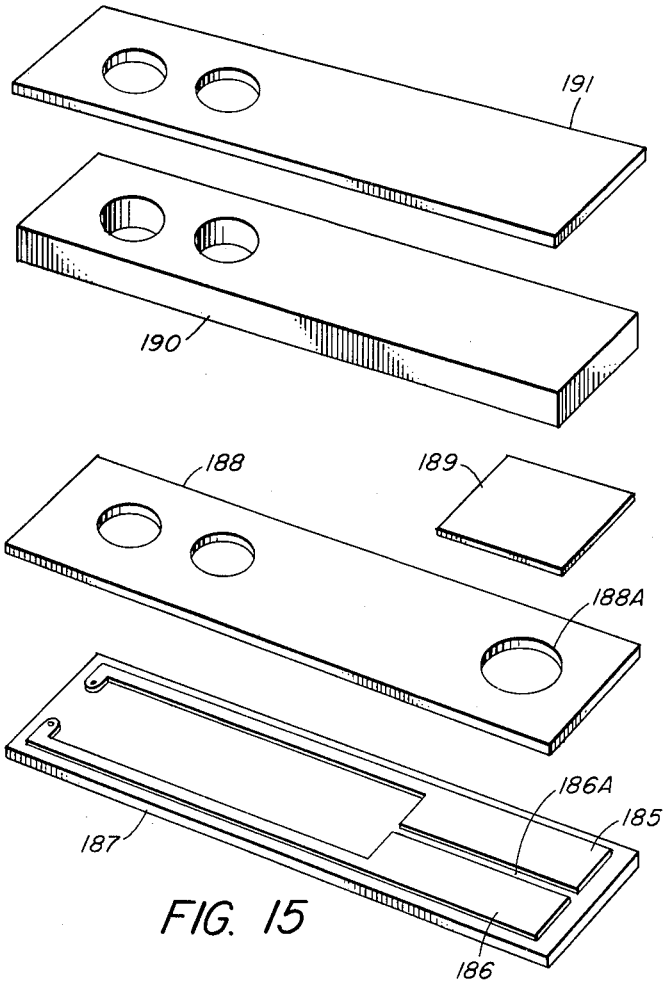
FIG. 15 is an exploded view of yet another embodiment of a relatively inexpensive touch-sensitive device suitable for stacking with similar devices to provide different touch-sensitive features.
Figure 17:
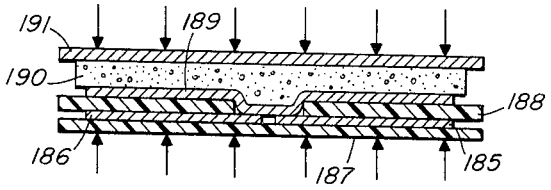
FIG. 17 is a cross-sectional end view similar to that shown in FIG. 16 with a compressive force being applied.

FIG. 15 shows an exploded view of another embodiment of a touch-sensitive device which has a fewer number of laminated plates in comparison with arrangements hereinbefore discussed, and hence can be fabricated at reduced costs. This device comprises a baseboard 187, an insulating aperture plate 188, a flexible and deformable sheet 189, a resilient pad 190, and an upper plate 191. The members 187, 188, 190 and 191 each have two holes therethrough at the left thereof for facilitating the mounting of the device in a single unit. The aperture plate 188 also has an aperture 188*a* which is covered on one side by sheet 189 and on the other side by baseboard 187. The baseboard 187 includes two adjacent conductive areas 185 and 186 on the surface of board 187 which are arranged to be located symmetrically around the centerline of the board and separated by a narrow, non-conducting channel 186*a* which can be bridged by the portion of sheet 189 which is forced through the aperture 188*a* of sheet 188 when pad 190 is compressed, as shown in FIG. 17, between upper plate 191 and baseboard 187. It is noted also that conductive areas 185 and 186 have longitudinal extensions that connect to electrical terminations at the left of baseboard 187.

Figure 16:
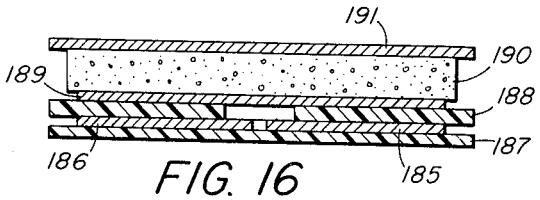
FIG. 16 is a cross-sectional end view of the assembled device depicted in FIG. 15 in its uncompressed state.

In FIG. 16 the assembled device of FIG. 15 is shown in its uncompressed state wherein the sheet 189 is separated from the conductive areas 185 and 186. In FIG. 17 the upper plate 191 has been compressed and a portion of the sheet 189 passes through the aperture 188*a* and contacts the areas 185 and 186. If several of these assemblies are mounted in a common stack as shown in FIG. 18, the upper plate 191 may be eliminated in all but the uppermost assembly.

In the embodiments shown in FIGS. 15–17 further savings can be effected since the compressible pad 190 need not be conductive. Sheet 189 can be made of a highly conductive material, and a resistive film can be applied to areas 185 and 186 on top of these areas which are normally conductive. Alternatively, a resistive material can be selected for sheet 189, in which case the metal surfaces of areas 185 and 186 need not have a resistive coating deposited thereon.

In one embodiment the device shown in FIGS. 15–17 was constructed with a sheet 189 of a highly conductive, silver-loaded silicone rubber sheet, and areas 185 and 186 of board 187 which is preferably a printed circuit board were copper conductors coated with a carbon-base resistive material in an organic binder. Other devices have been constructed in which sheet 189 is a resistive carbon loaded rubber-like material, and areas 185 and 186 of printed circuit board 187 are copper plated with a non-corrosive metal such as nickel with a gold-flash.

Figure 18:
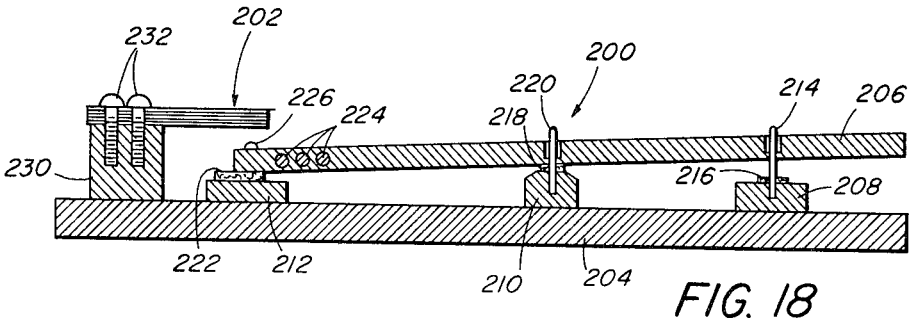
FIG. 18 is a vertical sectional side view showing the key structure and associated touch-sensitive device assembly which may include a plurality of devices of the type shown in FIG. 15.

Referring now to FIG. 18 there is shown a key assembly 200 having a touch responsive assembly 202 associated therewith. Key assembly 200 includes a base plate 204, a key 206, front rail 208, balance rail 210 and back rail 212. The front rail 208 has a guide pin 214 extending therefrom through an aperture provided in the key. A felt washer 216 is disposed on the top of rail 208. The balance rail 210 also has a felt washer 218 associated therewith and a guide pin 220 extending through an aperture provided in the key 206. The balance rail 210 is effectively the fulcrum for the key 206. The back rail 212 includes a felt pad 222 against which the end of the key 206 rests. At the end of the key adjacent the back rail 212 there may be provided a plurality of lead weights 224 securely disposed in the key and a bumper 226 which contacts the touch-responsive assembly 202 when the key is depressed at its righthand end as viewed in FIG. 18. The touch-responsive assembly includes a supporting block 230 fixedly supported from baseplate 204, and includes a pair of screws 232 for attaching the plurality of touch-responsive devices to the support 230. Each of the touch-responsive devices included in assembly 202 may be identical to the one as shown in FIG. 15.

Figure 19:
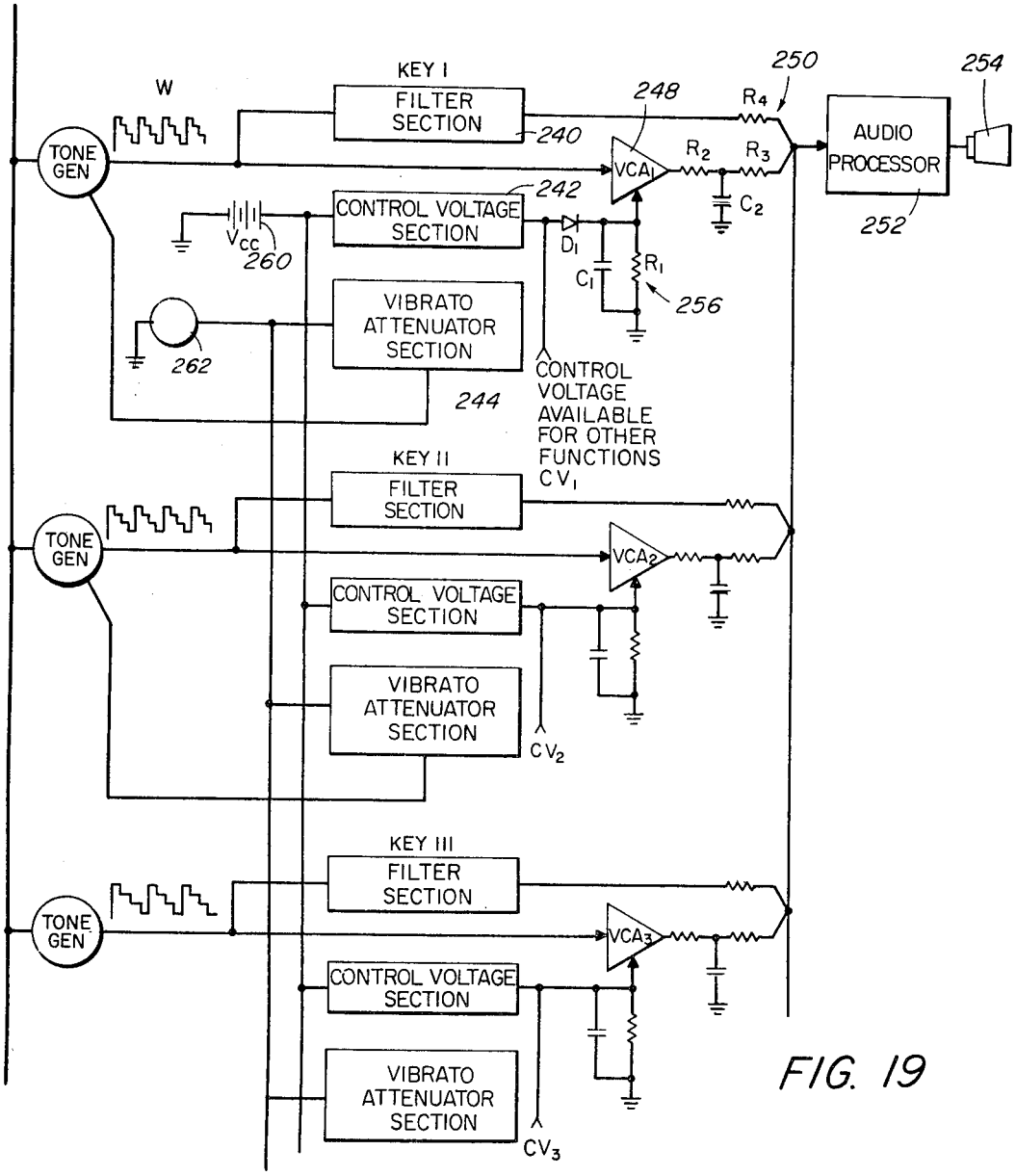
FIG. 19 is a circuit schematic diagram partially in block form of another embodiment of a touch-sensitive system for use in a polyphonic musical instrument or music synthesizer.

Referring now to FIG. 19 there is shown another embodiment of a touch-responsive system for use in a polyphonic musical instrument or music synthesizer. This embodiment is somewhat similar to the one shown in FIG. 9. In FIG. 19 there is shown circuitry associated with three keys of a keyboard. Because the circuitry associated with each key is similar only the circuitry associated with key I need be discussed in detail herein.

The system comprises a tone generator which may be a complex wave tone generator having a wave form W. It is noted in FIG. 19 that the period of the wave form W is different for each key. The touch-responsive assembly in FIG. 19 for key I is represented by three blocks referred to as the filter section 240, control voltage section 242 and vibrato attenuator section 244. Each of these sections may be of the type shown in FIG. 15.

The output of the tone generator couples to filter section 240 and also to voltage controlled amplifier 248. The output of filter section 240 couples by way of combining circuitry 250 to audio processing means 252 and in turn to output speaker 254 in a manner similar to that discussed previously with reference to FIG. 9. The output of the voltage controlled amplifier also couples to combining circuitry 250. Amplifier 248 is controlled from control voltage section 242 and has a delay circuit 256 associated therewith. This delay circuit provides a delaying time constant output when the key is released. The output of control voltage section 242 may also be used for other functions such as vibrato or growl. The input to the control voltage section 242 is provided from a typical battery 260 which couples to the control voltage sections associated with each key.

FIG. 19 also shows a vibrato attenuator section 244 which has an input couple from vibrator generator 262. Generator 262 also couples to the sections 244 associated with the other keys of the system. The output from the attenuator section 244 couples to the tone generator associated with that key for providing the vibrato effect.

Figure 20:
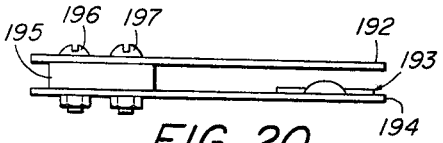
FIG. 20 shows another embodiment for the touch-sensitive device assembly shown in FIG. 18, in an uncompressed state.
Figure 21:
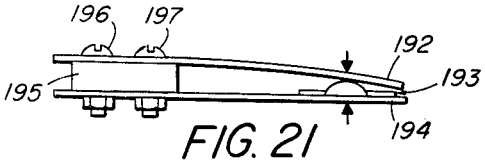
FIG. 21 is a view similar to that shown in FIG. 20 with the assembly in a compressed state.

FIG. 20 shows another embodiment for the touch-responsive assembly as shown in FIG. 18. In this embodiment, the stack 192 of devices is secured to a supporting block 195 by means of screws 196 and 197. A lower fixed plate 194 is also secured to block 195 by means of screws 196 and 197 and has a contacting bump 193 fixed to the end thereof. With the arrangement shown in FIG. 20 the stack 192 is deflected towards the bump 193 for causing touch-responsive action to the different touch-responsive devices comprising the stack. FIG. 21 shows the stack 192 in its compressed condition touching the bump 193.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In an electronic music system having at least one waveform oscillator, and a control voltage source, a touch responsive assembly composed of a plurality of stacked touch responsive devices comprising;

a touch responsive filter network, coupled from the waveform oscillator and having conductance means variable continuously over at least a portion of a selected conductance range in accordance with pressure applied to said stack over a range including a range corresponding to said selected conductance range, and a touch responsive control network coupled from the voltage source and having conductance means variable continuously over at least a portion of a selected conductance range in accordance with pressure applied to said stack over a range including a range corresponding to said selected conductance range.

2. The system of claim 1 comprising a voltage controlled amplifier.

3. The system of claim 1 wherein said assembly comprises a touch responsive attenuator network coupled from a vibrato generator and having conductance means variable in accordance with pressure applied to said stack.

4. An electronic music system of the keyboard or fingerboard type comprising;

a plurality of waveform oscillators, one associated with each key of the keyboard, a like plurality of touch responsive filter networks, one being coupled from each waveform oscillator, and output circuitry coupled from said plurality of touch responsive filter networks for combining signals therefrom, each said network comprising conductance means variable continuously over at least a portion of a selected conductance range in accordance with pressure applied to said filter network over a range including a range corresponding to said selected conductance range for varying the cutoff frequency thereof.

5. The system of claim 4 wherein each said waveform oscillator includes a tone generator.

6. The system of claim 4 wherein each said waveform oscillator includes a sawtooth generator.

7. The system of claim 4 wherein each said network includes a low pass filter network.

8. The system of claim 4 wherein said output circuitry includes a mixer, audio processor and amplifier.

9. The system of claim 4 comprising a voltage source, a plurality of touch responsive voltage networks each comprising conductance means variable in accordance with pressure applied, a voltage controlled amplifier and means coupling the output of said voltage network to said voltage controlled amplifier, said voltage network and filter network being concurrently responsive to applied pressure.

10. The system of claim 9 comprising a plurality of touch responsive vibrato networks responsive to applied pressure.

11. A system of claim 9 comprising a decay circuit coupled from said voltage controlled amplifier.

12. The system of claim 11 comprising a combining circuit responsive to the output of said voltage controlled amplifier and filter network.

13. The system of claim 9 wherein said voltage controlled amplifier has an input coupled from the waveform oscillator.

14. A touch sensitive keyboard for an electronic musical instrument comprising:

a plurality of keys each adapted to energize at least one circuit corresponding to a musical tone, one such circuit associated with each individual key, associated with and operated by said key, a body formed of an elastically deformable material adapted and positioned to make an electrical contact forming a resistive component of said circuit, a plurality of spaced-apart electrical contact members forming elements of a circuit controlled by said key, means separating said deformable material from an adjacent contact member, whereby key pressure at a threshold level brings said material into contact with said adjacent contact member to form a resistive contact between said spaced-apart contact members and increasing pressure above said threshold continuously increases the pressure of such contact and continuously increases the conductance of said contact in the normal operating range in response to increasing pressure above said threshold level, whereby an electrical response of said circuit is initiated by said threshold key pressure and continuously varied by increasing key pressure above said threshold level.

15. A touch sensitive keyboard for an electronic musical instrument according to claim 14, wherein said deformable material is adapted to be deformed under increasing key pressure to increase its area of contact with an adjacent contact member.

16. A touch sensitive keyboard for an electronic musical instrument according to claim 14, wherein the elastically deformable material is an electronically resistive material.

17. A musical keyboard device for providing an electrical conductance variable continuously over at least a portion of a selected conductance range in response to pressure applied thereto over a range including a range corresponding to said selected conductance range, said device comprising:

a musical instrument keyboard having a plurality of keys;

a plurality of bodies each formed of a mixture of elastically deformable electrically insulating material having particles of electrically conductive material dispersed therein in stacked relation to each other along the direction of pressure;

spaced-apart electrically conductive elements disposed one each between each pair of said bodies, and at each end of said stack, at least one of said elements being operable by a key of said keyboard to cause contact between said deformable body and an electrically conductive element;

apertured plates interposed between each conductive element to prevent contact between said body and said element until a pressure in excess of a predetermined pressure is applied to said bodies; and a plurality of capacitors, each connected to at least one of said conductive elements to form a low pass filter network.

18. A device as defined in claim 17 wherein the values of said capacitors are selected so that at a predetermined applied pressure the time constants of each stage comprising the network are substantially the same.

19. A device as defined in claim 17 wherein all said capacitors have substantially the same value.

* * * * *